United States Patent [19]

Mayer et al.

[11] Patent Number: 4,905,133

[45] Date of Patent: Feb. 27, 1990

[54] LAMP REFLECTOR

[75] Inventors: Mark J. Mayer, Lisle, Ill.; Charles D. Lemme, Tucson, Ariz.

[73] Assignee: Blazer International, Franklin Park, Ill.

[21] Appl. No.: 396,147

[22] Filed: Aug. 18, 1989

[51] Int. Cl.[4] ..... F21V 7/00

[52] U.S. Cl. ..... 362/346; 362/297; 362/348; 362/350

[58] Field of Search ..... 362/297, 346, 348, 350

[56] References Cited

U.S. PATENT DOCUMENTS

| | | | |
|---|---|---|---|
| 1,639,363 | 8/1927 | Balsille . | |
| 1,814,326 | 7/1931 | Melton . | |
| 2,274,405 | 7/1940 | Flaherty . | |
| 2,806,134 | 9/1957 | Tarcici | 362/350 |
| 3,337,871 | 8/1967 | Greenberg | 362/350 |
| 3,758,770 | 9/1973 | Morasz . | |
| 4,028,542 | 6/1977 | McReynolds, Jr. . | |
| 4,149,227 | 4/1979 | Dorman . | |
| 4,293,900 | 10/1981 | Dziubaty . | |
| 4,447,865 | 5/1984 | VanHorn et al. . | |
| 4,494,176 | 1/1985 | Sands et al. | |

FOREIGN PATENT DOCUMENTS

| | | | |
|---|---|---|---|
| 348329 | 2/1905 | France | 362/346 |
| 269671 | 4/1927 | United Kingdom | 362/346 |

*Primary Examiner*—Douglas Hart

*Attorney, Agent, or Firm*—Willian Brinks Olds Hofer Gilson & Lione

[57] ABSTRACT

A fog lamp reflector includes a reflector body having a reflector surface made up of a series of paraboloid strips arranged side by side along a lateral direction. Each of the strips defines a respective focus, and all of the focuses coincide at a selected point in space. The strips are aimed at multiple converging directions to laterally disperse reflected light originating at the selected point, and each of the strips defines a respective focal length. The focal lengths of strips progressively farther from the center are progressively greater. The focuses are selected such that adjacent strips are matched in position and the reflector surface is substantially continuous. The reflector surface has a second derivative of lateral displacement with respect to axial displacement which is substantially continuous throughout the reflector surface to provide a visually smooth appearance.

8 Claims, 2 Drawing Sheets

6
6
20
20

LAMP REFLECTOR

BACKGROUND OF THE INVENTION

This invention relates to an improved reflector for a lamp such as a fog lamp, wherein the reflector itself distributes light in a desired non-collimated pattern and yet has a continuous surface which is visually smooth.

Prior art vehicular lamps known to the inventors have used either optics in the lens to disperse collimated light laterally from a parabolic reflector, or have used reflectors having obvious joints between various sections of the reflector. See for example Balsillie U.S. Pat. No. 1,639,363, which discloses a reflector in FIG. 1 having a plurality of segments 19–26 which are convexly shaped to disperse light laterally in the region 28.

Melton U.S. Pat. No. 1,814,326 discloses another headlight reflector, which in this case is made up of segments that are discontinuous with respect to adjacent segments. Other patents showing reflectors which are visually segmented to provide desired light distribution are shown in Flaherty U.S. Pat. No. 2,274,405, Morasz U.S. Pat. No. 3,758,770, Sands U.S. Pat. No. 4,494,176, Van Horn U.S. Pat. No. 4,447,865, Dziubaty U.S. Pat. No. 4,293,900 and McReynolds U.S. Pat. No. 4,028,542. In each case, the visually apparent segments on the reflector result in a non-uniform appearance which is objectionable in many applications.

Dorman U.S. Pat. No. 4,149,227 discloses a reflector for a dental surgical lighting system. This reflector is ellipsoidal in shape, and the reflector surface is divided into stripes. Each stripe defines a respective ellipsoid, and the ellipsoids are rotated outwardly with respect to one another as shown in FIG. 6 to spread the reflected light along one axis, thereby enlarging the illuminated area. As shown in FIG. 12, the rotated ellipsoids may have focuses that are offset slightly with respect to one another. Alternately, as shown in FIG. 13, the ellipoidal surfaces may be recalculated to ensure that all of the focuses coincide. Note the discussion at columns 6 and 7, and in particular the discussion at column 6, line 59 through column 7, line 18. The Dorman patent utilizes ellipsoids of revolution rather than paraboloids of revolution, and therefore causes reflected light to converge at the conjugate focus, and to diverge thereafter in both the horizontal and vertical directions. This dispersion pattern is unsuitable for many vehicular lamps. Furthermore, the Dorman patent discloses a reflector which is non-uniform in visual appearance, because of the cusps 51, 50 between adjacent ellipsoids (FIG. 6), and therefore does not provide the visually smooth appearance required in many applications.

The present invention is directed to an improved reflector having a visually smooth surface through a portion that occupies at least a quadrant of the reflector, yet which disperses light away from an optical axis in the horizontal direction in a pattern suitable for vehicular lamps.

SUMMARY OF THE INVENTION

According to this invention, a lamp reflector is provided which comprises a reflector body which defines a reflector surface comprising a series of paraboloid strips arranged side by side along a lateral direction and including a central paraboloid strip. Each of the paraboloid strips defines a respective focus, and all of the focuses substantially coincide at a selected point in space. The paraboloid strips are aimed in a plurality of non-parallel directions to laterally disperse reflected light originating at the selected point in space. Each of the paraboloid strips defines a respective focal length, and the focal lengths of paraboloid strips progressively farther from the central paraboloid strip are progressively greater. The focuses are selected such that adjacent paraboloid strips are matched in position and the reflective surface is substantially continuous. The reflector body defines a region extending over at least one quadrant, and the second derivative of lateral displacement with respect to axial displacement is substantially continuous throughout this region to provide a visually smooth appearance to the region.

The preferred embodiment described below is a vehicular lamp which has a reflector shaped in accordance with this invention to disperse light in a pattern suitable for a fog lamp. This embodiment collimates light in the vertical direction, while causing reflected light to converge and then to diverge in the horizontal direction. Since light dispersion is accomplished by the reflector, plain, transparent glass can be used for the lens. In fact, it may be inappropriate to call the glass sheet covering the reflector a lens, because it no longer performs any light focusing or dispersing function. This advantage is obtained without producing any visually apparent segments, cusps, or the like in the reflector. The overall result with the preferred embodiment described below is a fog lamp reflector having much of the visual appearance of a conventional driving lamp reflector, while nevertheless dispersing light laterally as appropriate for a fog lamp.

In the embodiment described below, paraboloid strips progressively farther from the center are rotated inwardly by progressively larger angles and have progressively larger focal lengths. Such larger focal lengths have the advantage of reduced sensitivity to filament position. Because reflected light converges and then diverges in the horizontal plane, a lens which is horizontally narrower can be used, or the reflector can be recessed further for a given width lens. Furthermore, undesired interference of the vehicle facia with the reflected light is reduced.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENT

In general, vehicular lamps require some lateral dispersion to illuminate the roadway to the left and right of the optical axis of the lamp, but must limit the vertical dispersion (glare) to minimize blinding of oncoming drivers.

A pattern suitable for a fog lamp consists of light which is relatively evenly distributed laterally up to some given limit. In North America, the relevant SAE specifications require a minimum of 1,000 candela out to at least 15 degrees left and right of center, and a maximum of 10,000 candela at the center. This specification evolved because of the nature of cylindrical prisms that have traditionally been used to laterally disperse light for vehicular lamps. Such prisms tend to direct more light straight ahead and less towards the side. With the present invention, light distribution can be made perfectly uniform, or even brighter toward the sides than at the center of the distribution.

Figure 1:
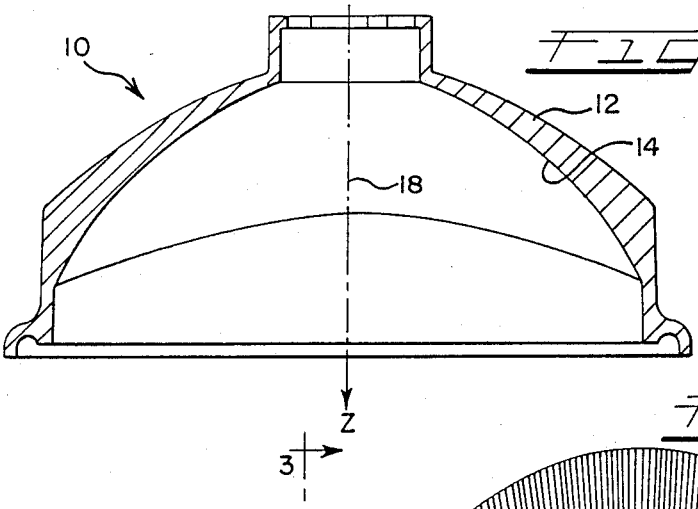
FIG. 1 is a vertical sectional view through a reflector which incorporates a presently preferred embodiment of this invention.

Turning now to the drawings, FIG. 1 shows a horizontal cross-section through a lamp reflector 10 which incorporates a presently preferred embodiment of this invention. This reflector 10 includes a reflector body 12 which in this embodiment is circular in shape, and which defines a central aperture for receiving a bulb mounting fixture (not shown). The concave surface of the reflector body 12 defines a reflector surface 14 which is polished and coated with a highly reflective material such as aluminum.

According to this invention, the reflector surface 14 is made up of a combination of a number of paraboloid strips 16, each with its own, unique focal length selected such that the focuses of all of the paraboloid strips 16 coincide at the same point in space, indicated by the reference numeral 18 in FIG. 1. Preferably, this point 18 is aligned with the center of a filament (not shown) used with the reflector 10.

Figure 2:
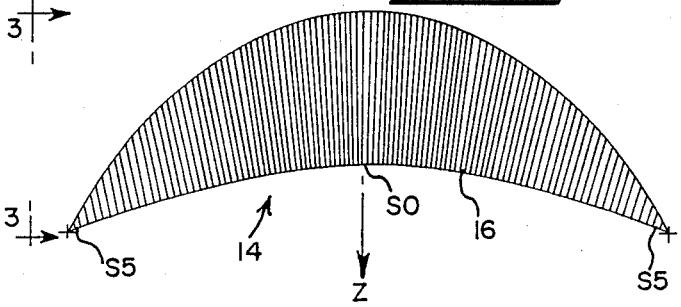
FIG. 2 is a schematic representation of the portion of the reflector surface shown in FIG. 1.
Figure 3:
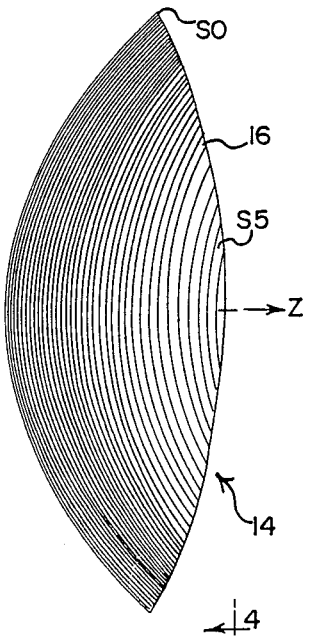
FIG. 3 is a schematic view taken along line 3—3 of FIG. 2.
Figure 4:
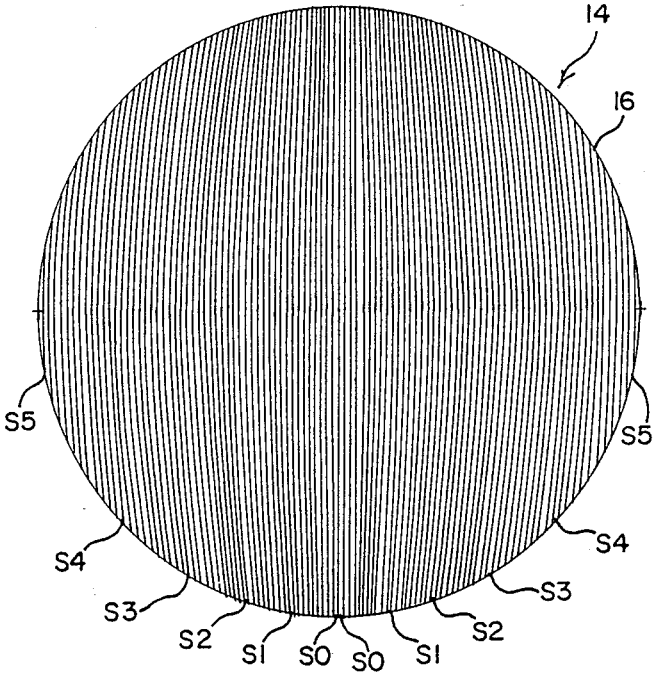
FIG. 4 is a schematic view taken along line 4—4 of FIG. 3.

FIGS. 2, 3 and 4 provide three schematic views of the reflector surface 14. FIG. 4 is a front view which shows the circular shape of the reflector surface 14. FIG. 3 is a side view and FIG. 2 is a view corresponding to FIG. 1. In all cases the optical axis of the reflector surface 14 (which extends horizontally when the lamp is mounted normally) is indicated with the reference symbol Z.

In this embodiment the overall diameter of the reflector surface 14 is 100 millimeters, and each of the paraboloid strips 16 is 1 millimeter in width. In FIG. 4 every tenth paraboloid strip is labeled a respective the symbol S0, S1, S2, S3, S4, S5. Because the reflector surface 14 is symmetrical with respect to the central paraboloid strip S0, the following discussion will relate to only one-half of the reflector surface 14. The parallel lines between the strips 16 in FIGS. 2–5 are schematic representations of the respective boundaries. In actuality, the entire reflector surface 14 is visually smooth and unsegmented, as described below.

It has been discovered that when a paraboloid with a horizontal axis is intersected by a vertical plane that does not pass through the focus, a second paraboloid that is rotated about a vertical axis through the focal point can be found that has a different focal length but uses the same focal point, and which intersects the first paraboloid along the vertical plane. The intersection of the two paraboloids will at most cause a change in slope (dx/dz) of the surface. There is no change in displacement, as the two paraboloids intersect exactly for all practical purposes. The distance between the vertical planes can be made as small as desired, so that the changes in slope become vanishingly small.

The paraboloid strips that make up the smoothed surface 14 are preferably calculated in a two step process. The first step is to determine the desired light distribution. This is done by knowing the desired final light distribution, and then choosing a few (4–7) coarse sections (i.e. slices that are separated by vertical planes parallel to the Z axis) with each coarse section focused on a different important angle of the final light distribution. Each coarse section will be filled by one paraboloid of constant focal length. The width of the these sections is chosen to provide the desired light distribution as appropriate for the final pattern.

The second step is then to smooth the various coarse sections into one continuously curving surface by forming additional vertical planes, parallel to the Z axis, that are even closer together and then finding the required focal lengths for each new paraboloid strip.

The end result is that the space to be occupied by the final reflector surface 14 is divided into thin vertical paraboloid strips, each with its own uniquely determined focal length. The rearmost point on the reflector and a focal point are chosen, and then an array of paraboloid strips are selected starting with the one directly behind the focus such that all of the paraboloid strips meet the following conditions:

1. All strips have the same point in space as the focus;
2. All strips are duplicated on both sides of center;
3. All strips match in position with both adjacent paraboloid strips;
4. Each paraboloid strip has a slightly larger focal length than the adjacent paraboloid strip that is nearer the center.

Preferably, when choosing the width of the coarse sections in the first step, the direction and shape of the filament should be taken into account, because a filament does not radiate a constant amount of light when seen from differing angles.

In the first step of the two step process described above, the lateral range is broken into coarse sections in order to obtain the correct light distribution. Each coarse section is separated by vertical planes parallel to the Z axis. For SAE specifications 3 degree increments are useful for aiming successive coarse sections, because test points are set at multiples of 3 degrees. The following is an example of how to calculate the focal lengths for SAE specifications. For other specifications, such as those used in Europe, it will be obvious how to modify this technique to obtain the desired result.

Each coarse segment is intended to aim light at a different angle, and the angles are separated by 3 degrees in this example. In this example, it is intended to have even light distribution from 0 degrees (straight ahead) to left and right 15 degrees. Since the second step of calculation of the focal lengths has the effect of rotating the coarse sections inwardly by one-half of the increment between sections (in order to direct reflected light outwardly by the same amount as it diverges after its initial convergence), we choose the aiming angles of the coarse sections to be 1.5 degrees smaller than the final desired result. Therefore the coarse sections are aimed at 0°, 1.5°, 4.5°, 7.5°, 10.5° and 13.5°, respectively. Because the filament has finite length and is not a point source at the focus, there will be automatic lateral dispersion for a laterally placed filament so that light aimed by a given coarse section will in reality be smeared laterally by the filament length. At this point, the general shape of the desired lamp must be established, as well as the position of the focus for the central portion of the reflector that projects light straight ahead. Any shape is possible, but round and rectangular reflectors are often used. In this example we assume a round lamp with a diameter of 100 millimeters and a central focal length of 25.4 millimeters.

The effective spherical angle for each of the coarse sections is then selected to produce the desired light distribution. This can be done by calculating the contribution for stripes of narrow width which are broken into a square grid, such as 1 millimeter on each side. Additional vertical stripes of paraboloid are added until the total effective spherical angle for each coarse section reaches the desired value.

Once a coarse section has been established, the coarse section for the next paraboloid is created. This next paraboloid is rotated inwardly to point at the next aim point on the other side of the Z axis and is found by placing a vertical plane parallel to the Z axis through the outermost side of the last coarse section on a CAE (Computer Aided Engineering) screen and then truncating all the prior paraboloid to the right of this plane. The focal length of the new, rotated paraboloid is always larger than the prior one. An estimate is made as to this new focal length, and the new rotated paraboloid is drawn. All of this paraboloid to the left of the vertical plane is discarded and the intersection of the two paraboloids is inspected with whatever magnification is desired. If the fit between the two is not close enough, the focal length of the new paraboloid is modified and the fit is rechecked until the intersection is as close to continuous as is required for the particular application. Then the effective spherical angle of this new coarse section is adjusted as described above until it equals the desired value. This process is continued until the width reaches its desired maximum.

Once all of the coarse sections have been calculated, the sum of their effective spherical angles will be more than the amount allotted to them in the first generation because the surface now extends further forward for the same diameter. This new sum is then used as the starting point for a next itteration, if necessary.

Once the coarse sections have been determined, the second step of the process is to smooth them by dividing them into narrower strips. In the first coarse section three paraboloid strips, each 1 millimeter in width, are left unchanged, aimed parallel to the Z axis. The remaining paraboloid strips in the first coarse section are each rotated 0.75 degrees inwardly with respect to the adjacent strip such that the fifth one matches the adjoining coarse section. With each paraboloid strip the strategy discussed above is used to match the paraboloid strips at their intersections. Within each coarse section individual paraboloid strips are progressively rotated toward the Z axis. This has the effect of rotating the light from each coarse section an average of half the incremental angle between coarse sections.

After the second step, light from each coarse section is aimed smoothly and equally along a 3 degree arc. This is in addition to the lateral smoothing due to filament length. Table 1 supplies information regarding the focal length and the aiming angle of each of the 50 1 mm wide paraboloid strips 16 in one-half of the reflector surface 14. The first column lists a value equal to two times the focal length, and the second column lists Theta, the aiming angle or angle of convergence with the Z axis.

FIG. 4 shows 12 individual ones of the paraboloid strips 16 labelled as S0–S5. S0 corresponds to Section No. 1 on Table 1 and strips S1, S2, S3, S4, S5 correspond to Section Nos. 10, 20, 30, 40, 50, respectively.

From Table 1 it will be apparent that strips S0–S5 are aimed at about the following aiming angles Theta:

$\theta_{S0}=0°$;
$\theta_{S1}=5°$;
$\theta_{S2}=9°$;
$\theta_{S3}=13°$;
$\theta_{S4}=15°$;
$\theta_{S5}=16°$.

Each of the strips S0–S5 defines a respective focal length F0–F5. In this embodiment these focal lengths are configured in the following ratios:

F1/F0=1.01;
F2/F0=1.02;
F3/F0=1.04;
F4/F0=1.07;
F5/F0=1.08.

Figures 5, 6:
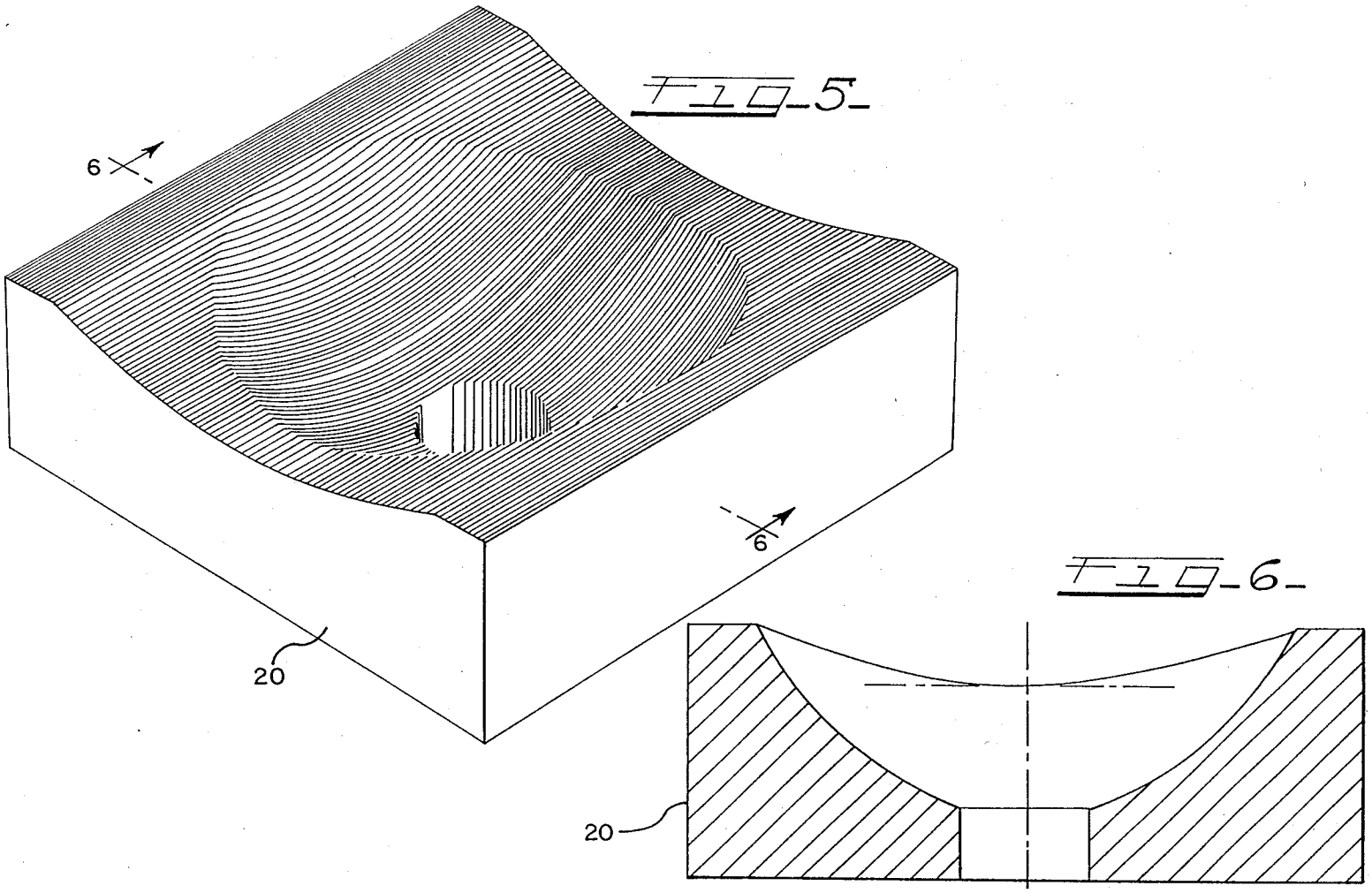
FIG. 5 is a schematic perspective view of an electrode used to form the reflector of FIG. 1.
FIG. 6 is a cross-sectional view taken along line 6—6 of FIG. 5.

The final data generated by the CAE program encoding the paraboloid strips listed in Table 1 is then used to cut a female cavity with a ball mill in the desired final shape of the reflector surface 14. Preferably the ball mill has a diameter of 25.4 mm and it produces a female cavity generally as shown in FIG. 5. Preferably, the cavity is formed from a block of oxygen free copper which forms an electrode 20. This cavity is then polished to ensure that the entire reflector surface is visually smooth, and that any lines between adjacent paraboloid strips are made invisible. In this context, visually smooth is used to indicate a situation wherein the second derivative of lateral displacement (transverse to the strips 16) with respect to axial displacement (along the Z axis) is substantially continuous throughout the reflector surface. Once the electrode 20 is formed, it is used in a conventional electro machining operation to form a hard steel core (not shown) that is then used to mold or otherwise form the final reflector body 12. The reflector body 12 can be die cast, injection molded from plastic, or drawn from sheet metal. In the preferred embodiment, the reflector body 12 is die cast from zinc alloy and then coated with a reflecting material such as aluminum.

Of course, the present invention can be adapted to lamps of other shapes (such as square lamps) and to lamps other than fog lamps (such as driving lamps). The aiming angles and focal lengths of the individual paraboloid strips can be altered as appropriate for the particular application. For example, it is not essential that the visually smooth region of the reflector surface of this invention occupy the entire reflector surface. It may be desirable in driving lamps to make the visually smooth region occupy as little as one quarter or quadrant of the reflector surface. This may be appropriate for example where individual quadrants are aimed in separate directions in driving lamps.

In addition, the above-described two step design process is not required in all applications. Alternately, the equatorial section of the reflector can be chosen as a desired curve, such as an ellipse, and paraboloid strips passing through this curve can then be selected.

It is therefore intended that the foregoing detailed description be regarded as illustrative rather than limiting, and that it be understood that it is the following claims, including all equivalents, which are intended to define the scope of this invention.

We claim:

1. A lamp reflector comprising:

a reflector body which defines a reflector surface comprising a series of paraboloid strips arranged side by side along a lateral direction, said series comprising a central paraboloid strip;

wherein each of the paraboloid strips defines a respective focus and all of the focuses substantially coincide at selected point in space;

wherein the paraboloid strips are aimed in a plurality of non-parallel directions to laterally disperse reflected light originating at the selected point in space;

wherein each of the paraboloid strips defines a respective focal length and the focal lengths of paraboloid strips progressively farther from the central paraboloid strip are progressively greater; and wherein the focuses are selected such that adjacent paraboloid strips are matched in position such that the reflector surface is substantially continuous;

said reflector body defining a region extending over at least one quadrant, wherein the second derivative of lateral displacement with respect to axial displacement is substantially continuous throughout the region to provide a visually smooth appearance to the region.

2. The invention of claim 1 wherein the reflector body is substantially circular.

3. The invention of claim 1 wherein each of the paraboloid strips defines a width no greater than about 1 mm.

4. The invention of claim 1 wherein the plurality of paraboloid strips on one side of the central paraboloid strip comprises six equally spaced paraboloid strips S0–S5, each having a respective focal length F0–F5, wherein S0 is the central strip and S5 is the outermost strip, and wherein the five focal lengths F1–F5 are in substantially the following ratios with respect to F0:

F1/F0=1.01;
F2/F0=1.02;
F3/F0=1.04;
F4/F0=1.07;
F5/F0=1.08.

5. The invention of claim 4 wherein the plurality of strips comprises a plurality of additional strips interspersed between S0 and S1, between S1 and S2, between S2 and S3, between S3 and S4, and between S4 and S5.

6. The invention of claim 1 wherein the plurality of paraboloid strips on one side of the central paraboloid strip comprises six equally spaced paraboloid strips S0–S5, wherein S0 is the central strip and S5 is the outermost strip, and wherein the strips S0–S5 are aimed at substantially the following angles $\theta_{S0}$–$\theta_{S5}$ with respect to a central axis:

$\theta_{S0}=0°$;
$\theta_{S1}=5°$;
$\theta_{S2}=9°$;
$\theta_{S3}=13°$;
$\theta_{S4}=15°$;
$\theta_{S5}=16°$.

7. The invention of claim 6 wherein the plurality of strips comprises a plurality of additional strips interspersed between S0 and S1, between S1 and S2, between S2 and S3, between S3 and S4, and between S4 and S5.

8. The invention of claim 6 wherein the strips S0–S5 are aimed at substantially the following angles $\theta_{S0}$–$\theta_{S5}$ with respect to a central axis:

$\theta_{S0}=0°$;
$\theta_{S1}=5°$;
$\theta_{S2}=9°$;
$\theta_{S3}=13°$;
$\theta_{S4}=15°$;
$\theta_{S5}=16°$.

* * * * *

UNITED STATES PATENT AND TRADEMARK OFFICE

CERTIFICATE OF CORRECTION

PATENT NO. : 4,905,133

DATED : February 27, 1990

INVENTOR(S) : MARK J. MAYER et al.

It is certified that error appears in the above-identified patent and that said Letters Patent is hereby corrected as shown below:

In column 6, between lines 64 and 65, please insert:

TABLE 1

| SEC. # | 2f | THETA | SEC # | 2f | THETA |
|---|---|---|---|---|---|
| 1 | 50.8 | 0 | 26 | 52.8947 | 12 |
| 2 | 50.8 | 0 | 27 | 53.0002 | 12.2727 |
| 3 | 50.8254 | .75 | 28 | 53.1069 | 12.5455 |
| 4 | 50.8508 | 1.5 | 29 | 53.2187 | 12.8182 |
| 5 | 50.8915 | 2.25 | 30 | 53.3359 | 13.0909 |
| 6 | 50.9439 | 3.0 | 31 | 53.4614 | 13.3636 |
| 7 | 50.9745 | 3.4286 | 32 | 53.5868 | 13.6364 |
| 8 | 51.0153 | 3.8571 | 33 | 53.7207 | 13.9091 |
| 9 | 51.0612 | 4.2857 | 34 | 53.8601 | 14.1818 |
| 10 | 51.1122 | 4.7143 | 35 | 54.0041 | 14.4545 |
| 11 | 51.1684 | 5.1429 | 36 | 54.1500 | 14.7273 |
| 12 | 51.2347 | 5.5714 | 37 | 54.3034 | 15.00 |
| 13 | 51.3060 | 6 | 38 | 54.3467 | 15.0714 |
| 14 | 51.4012 | 6.5 | 39 | 54.3911 | 15.1429 |
| 15 | 51.4969 | 7 | 40 | 54.4386 | 15.2143 |
| 16 | 51.6000 | 7.5 | 41 | 54.4841 | 15.2857 |
| 17 | 51.711 | 8 | 42 | 54.5327 | 15.3571 |
| 18 | 51.8295 | 8.5 | 43 | 54.5873 | 15.4286 |
| 19 | 51.9577 | 9 | 44 | 54.6365 | 15.5000 |

UNITED STATES PATENT AND TRADEMARK OFFICE

CERTIFICATE OF CORRECTION

PATENT NO. : 4,905,133

DATED : February 27, 1990

INVENTOR(S) : MARK J. MAYER et al.

It is certified that error appears in the above-identified patent and that said Letters Patent is hereby corrected as shown below:

TABLE 1 (continued)

| SEC. # | 2f | THETA | SEC # | 2f | THETA |
|---|---|---|---|---|---|
| 20 | 52.0714 | 9.4286 | 45 | 54.6911 | 15.5714 |
| 21 | 52.1948 | 9.8571 | 46 | 54.7404 | 15.6429 |
| 22 | 52.3226 | 10.2857 | 47 | 54.8006 | 15.7143 |
| 23 | 52.4568 | 10.7143 | 48 | 54.8576 | 15.7857 |
| 24 | 52.5978 | 11.1429 | 49 | 54.9180 | 15.8571 |
| 25 | 52.7430 | 11.5714 | 50 | 54.9750 | 15.9286 |
| | | | 50.8 | 55.0335 | 16.0000 |

Signed and Sealed this

Second Day of March, 1993

*Attest:*

*Attesting Officer*

STEPHEN G. KUNIN

*Acting Commissioner of Patents and Trademarks*